United States Patent [19]

Barkas

[11] 4,271,337

[45] Jun. 2, 1981

[54] SAFETY RECEPTACLE

[75] Inventor: Emanuel E. Barkas, Hamden, Conn.

[73] Assignee: Harvey Hubbell Incorporated, Orange, Conn.

[21] Appl. No.: 76,245

[22] Filed: Sep. 17, 1979

[51] Int. Cl.[3] ..... H01R 33/30

[52] U.S. Cl. ..... 200/51.09; 339/40

[58] Field of Search ..... 200/51 R, 51.09; 339/14 R, 40

[56] References Cited

U.S. PATENT DOCUMENTS

| | | | |
|---|---|---|---|
| 1,146,938 | 7/1915 | Hubbell | 200/51 R |
| 2,336,218 | 12/1943 | Blinn | 339/40 |
| 2,500,474 | 3/1950 | Sperrazza | 200/51.09 |
| 2,531,625 | 11/1950 | Hubbell | 200/51.09 |
| 2,540,496 | 2/1951 | Sperrazza | 200/51.09 |
| 2,545,536 | 3/1951 | Von Holtz | 339/40 |
| 2,770,786 | 1/1957 | Czyzewski | 339/40 |
| 2,826,652 | 3/1958 | Piplack | 200/51.09 |
| 3,238,492 | 3/1966 | Houston | 339/40 |
| 3,699,285 | 10/1972 | Leatherman | 200/51.09 |
| 3,775,726 | 11/1973 | Gress | 339/14 |
| 3,846,598 | 11/1974 | Mucsi | 200/51.09 |
| 3,909,566 | 9/1975 | Morrison et al. | 200/51.07 |
| 3,963,292 | 6/1976 | Smith | 339/14 R |
| 3,980,370 | 9/1976 | Gonzalez-Hernandez | 339/40 |

FOREIGN PATENT DOCUMENTS

| | | | |
|---|---|---|---|
| 508415 | 6/1939 | United Kingdom | 339/40 |

*Primary Examiner*—John W. Shepperd

[57] ABSTRACT

A safe electrical receptacle has internal switches to connect the power source to female connector elements when plug blades are inserted through openings in the receptacle cover. A blade inserted through one opening closes the switch to energize the female element behind the other opening. Slidable switch operators are disposed between the receptacle housing cover and the female elements and are moved laterally to close the switches before the plug blades engage the female elements.

6 Claims, 11 Drawing Figures

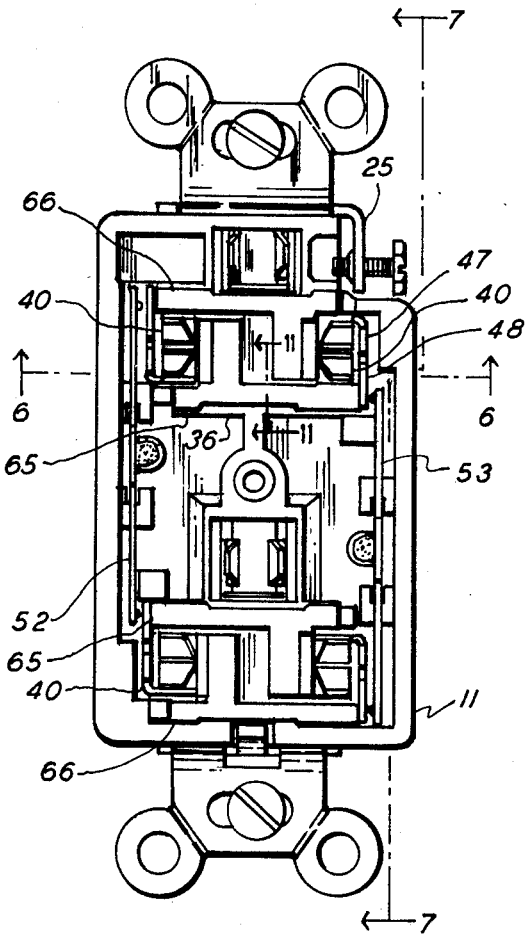
FIG. 8
FIG. 10
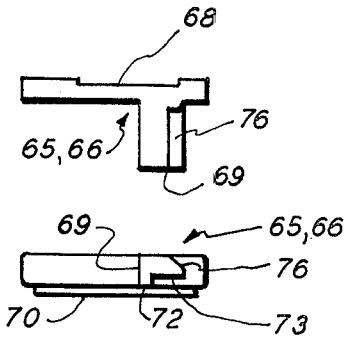
FIG. 9
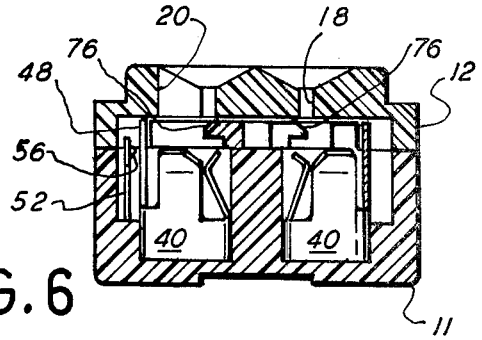
FIG. 6
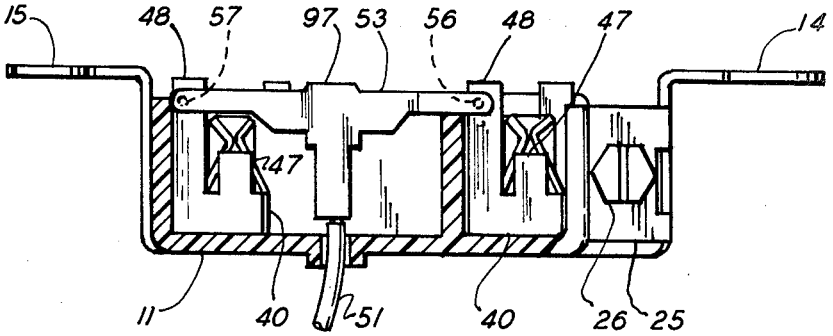
FIG. 7

SAFETY RECEPTACLE

This invention relates to electrical outlets and, more specifically, to receptacle structures having improved characteristics of safety and durability.

BACKGROUND OF THE INVENTION

It has been recognized for many years that an electrical outlet can constitute a hazard under certain circumstances and as to certain individuals, notably children, but also adults of limited mental capacity. Because the conventional outlet normally has two or more energized, electrically conductive contact surfaces which are rather easily reached through openings in an insulating cover plate, insertion of a pin or other electrically conductive probe can result in serious shock.

The recognition of this and similar problems has resulted in numerous efforts to provide a safer outlet, and some of these efforts are illustrated in the following United States Patents:

U.S. Pat. No. 2,336,218, Blinn
U.S. Pat. No. 2,500,474, Sperrazza
U.S. Pat. No. 2,545,536, Von Holtz
U.S. Pat. No. 2,770,786, Czyzewski
U.S. Pat. No. 3,238,492, Houston
U.S. Pat. No. 3,601,758, Davidson
U.S. Pat. No. 3,775,726, Gress
U.S. Pat. No. 3,909,566, Morrison et al
U.S. Pat. No. 3,980,370, Gonzalez-Hernandez A review of these reveals that some of the solutions arrived at are extremely complicated and, therefore, have not received wide acceptance. Others do not provide adequately safe or reliable solutions. As will be recognized, it is extremely important that the outlet must not only solve the problem but it must do so in a structure which can be manufactured at reasonable cost. Otherwise, the safer outlet simply will not be used.

One of the more interesting solutions is that shown in the patent to Sperrazza (U.S. Pat. No. 2,500,474) which employs a pair of switch contacts within the outlet housing and operators to close the switch contacts when the plug blades are inserted into the outlet. The concept employed in the Sperrazza structure is that the wire leading to each of the two female elements in the outlet is connected through a normally open series switch and the switch which supplies power to one female element is closed when a plug blade (or similar object) is inserted into the other female element. Thus, in order for power to be supplied to both female elements, blades must be inserted into both. As will be recognized, insertion of a foreign object into one female element presents no danger because that insertion only energizes the other element into which nothing has been inserted.

While this is clearly a valid concept insofar as safety is concerned, the structure of Sperrazza has certain disadvantages largely associated with normal usage of the outlet. First, it will be seen that the switch contacts are closed after the plug blades have made contact with the female elements, the purpose of this arrangement being to avoid arcing at the outlet front opening location. It has been found, however, that arcing occurs, under some conditions, across the switch contacts themselves. This arcing tends to degrade the contacts, shorting their lives and requiring replacement of these relatively expensive components. The switch contacts are necessarily rather small in surface area so that, under arcing conditions, the current density is high and the resulting arc relatively hot. Thus, the device has limited life.

Second, the Sperrazza device is limited in its flexibility in the sense that it is designed to receive only plug blades which are essentially parallel to each other. While this is suitable for some forms of plugs, there are other blade arrangements for which safe receptacles could and should be provided, and the Sperrazza structure does not appear to be usable with at least some other arrangements, notably orthogonal blade orientations, because of the disposition of switch components within the housing.

Third, it is common practice today, and is required under some conditions, to provide a third prong on the plug for grounding purposes and to provide a grounded female element in the receptacle to receive that prong. The Sperrazza structure has no provision for a grounding element and, again because of the limited space and the arrangement of parts necessary to allow the Sperrazza device to operate as intended, a place for a grounding element does not exist.

Fourth, Sperrazza employs relatively long and narrow curved spring elements which not only occupy much of the valuable space within the receptacle housing but also involve considerable heat generation. The spring elements are part of the current-carrying circuits in the receptacle and thus generate heat in accordance with the well-known power dissipation relationship $I^2R$. While the resistance of the elements would certainly be made as low as possible, there is a practical lower limit because the material used and the geometry must be chosen to provide the necessary spring characteristics. The result is some internal heating within the receptacle housing.

BRIEF DESCRIPTION OF THE INVENTION

An object of the present invention is to provide an electrical receptacle having switched power circuits to reduce electrical shock hazard resulting from insertion of conductive foreign objects into the receptacle.

A further object is to provide such a receptacle which is adaptable to accommodate differing plug blade orientations, and particularly to accommodate various blade orientations by changing only the cover plate.

Yet another object is to provide such a receptable in which operating members for the switches are electrically non-conductive bodies laterally movable between the receptacle cover and the female conductive elements which are to receive plug blades so that the plug blades, upon insertion, move the operating members and close the switches before the blades engage the female elements.

A still further object is to provide such a receptacle adapted to accommodate three prong plugs of the grounding type, the receptacle housing having no exposed electrically active terminals.

Briefly described, the invention includes, in an improved electrical receptacle of the type having a housing, at least two electrically conductive female elements supported in the housing for receiving and making electrical contact with blades of a cooperating plug, a cover for the housing having openings therethrough aligned with the elements, first and second conductor means for electrically connecting each of the elements to a source of electrical power, first and second normally open switches, each of the switches being in series circuit relationship between one of the elements and one of the conductor means, and switch operator means for closing the switches, the improvement wherein said switch operator means comprises first and second independently movable operating members each having a portion lying in a plane between the cover and the female elements, each said portion having a cam surface between one of the elements and its aligned cover opening so that a body inserted through one of the openings contacts a cam surface on one of the members and moves that member to close the one of the switches associated with the element aligned with the other opening before the body contacts the element behind the one opening.

In order that the manner in which the foregoing and other objects are attained in accordance with the invention can be understood in detail, particularly advantageous embodiments thereof will be described with reference to the accompanying drawings, which form a part of this specification, and wherein:

FIG. 6 is a transverse sectional view along line 6—6 of FIG. 8;

FIG. 7 is a side elevation, in longitudinal section, along line 7—7 of FIG. 8;

FIG. 8 is a front elevation of a receptacle in accordance with the invention showing all components in place but with the cover removed;

FIGS. 9 and 10 are side elevation and plan views, respectively, of a switch operating member usable in the receptacle of the invention.

Figure 1:
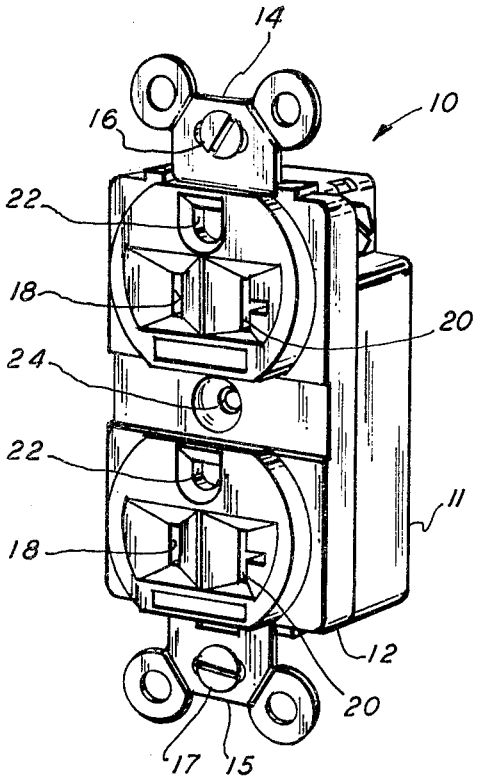
FIG. 1 is a perspective view of a receptacle structure in accordance with the invention.

As seen in FIG. 1, the receptacle indicated generally at 10 includes a housing 11 and a cover 12. The housing is generally rectangular in shape and is in the form of a hollow box having an open side, preferably molded using a heat and impact resistant thermoplastic material. As is conventional in such receptacles, longitudinally extending mounting tabs 14 and 15 protrude beyond the ends of the housing, the mounting tabs having openings to permit screws 16 and 17 to pass therethrough for mounting the receptacle in a conventional box. The tabs preferably constitute the end portions of a continuous metal strap member which is bent so as to pass along the ends of the housing 11 and along the back surface thereof, providing a continuous mounting and grounding member.

The cover 12 has openings suitably disposed to receive the prongs and blades of a male plug of conventional type to be used therewith. In the specific receptacle illustrated, which is a duplex receptacle, at each end thereof are openings 18 and 20 to receive the blades which will form part of the power circuit for the appliance being connected to the receptacle and a third opening 22 to receive the ground prong of a grounded three-prong connector. It will be observed that, in each case, opening 18 is rectangular in shape and opening 20 is T-shaped, opening 20 being designed to receive a blade which is either parallel to the blade to pass through opening 18, perpendicular thereto, or T-shaped. A plug in which the two blades to pass through openings 18 and 20 are parallel is referred to as a parallel blade plug, while a plug which has one blade to pass through opening 20 disposed in a plane perpendicular to that which passes through opening 18 will be referred to as an orthogonal blade plug. The ground prong is normally D-shaped in cross-section, and is commonly longer than the blades to go through openings 18 and 20.

Figure 2:
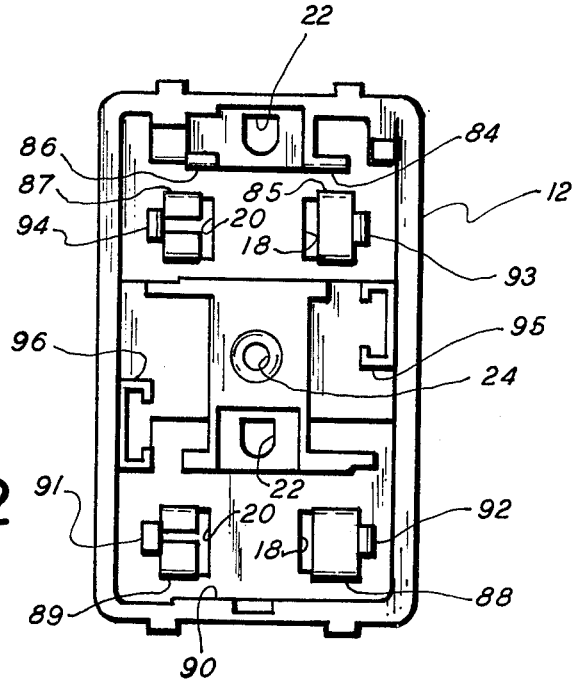
FIG. 2 is a vertical rear elevation showing the inner surface of the cover portion of the receptacle of FIG. 1.

FIG. 2 shows the inside surface of cover 12 and includes various molded guide and support surfaces and members which will be discussed in connection with components mounted and supported within housing 11. It will be observed that the openings 18, 20 and 22 are visible, and that, in both FIGS. 1 and 2, a central opening 24 is provided to receive a screw for holding the cover onto the housing.

Figure 3:
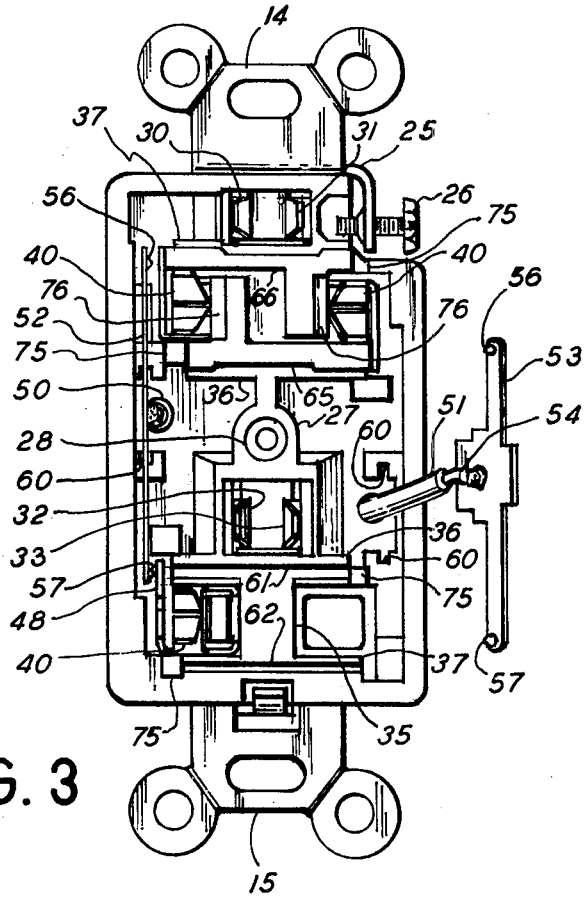
FIG. 3 is a front elevation of the receptacle of FIG. 1 with the cover removed and with portions thereof removed to display the housing structure.

FIG. 3 is a front elevation of the receptacle housing with the cover removed and with certain internal components removed and others in place so that the various support and guide portions of the housing itself can be seen. It will be noticed in FIG. 3 that a grounding tab 25 is an integal part of the strap of which mounting tabs 14 and 15 are a part and that the grounding tab extends around the side of the receptacle, into a small rectangular recess formed at one corner of the housing, the tab 25 having an internally threaded opening to receive a screw 26 to which a ground wire can be connected.

Within the housing itself are two substantially identical sets of elements to form the electrical connections for receiving male plugs, and those elements in one portion of the housing will be referred to by the same reference numerals as those in the other portion of the housing. It will also be observed that the housing includes a central, integrally molded wall 27 having an opening therethrough which receives an internally threaded electrically conductive sleeve 28 to receive the screw passing through opening 24 for the purpose of attaching the cover onto the housing. Sleeve 28 also passes through the back of the housing and passes through and is staked to the strap of which mounting tabs 14 and 15 form a part. Thus, the central screw is grounded. The strap of which the mounting tabs form a part also includes members bent into a U shape which protrude inwardly through the back of the housing and form female connector elements to receive the grounding prongs of the male receptacles. Near the upper portion of the housing contact blade elements 30 and 31 form the grounding element while for the lower portion the blades are identified as elements 32 and 33. In each case, the blade is formed so that it includes an inwardly convex surface to frictionally engage the grounding prong inserted therein, the material used being sufficiently springy metal so that good contact is made and maintained even after repeated insertions.

Figure 4:
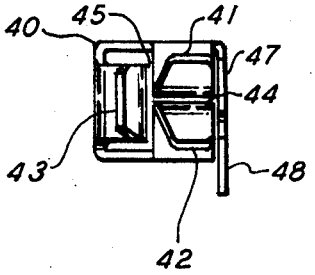
FIG. 4 is a front view of a female connector element usable in the apparatus of FIGS. 1 and 3.

The housing is provided with integrally molded interior walls defining four rectangular chambers to receive female contact elements, the chambers and elements being substantially identical. As seen near the bottom portion of the receptacle in FIG. 3, a longitudinal wall 35 and a transverse rib 36 cooperate with a wall 37 across the inner end of the receptacle housing to form two such chambers, each of which receives a female connector element 40. A similar arrangement appears at the opposite end of the receptacle, the walls at that portion of the figure being partially concealed by other components. An enlarged view of an element 40 is shown separately in FIG. 4 from which it will be seen that a piece of sheet metal is cut and bent to form a generally rectangular, and nearly square, enclosure with three upwardly or outwardly extending contact blades 41, 42 and 43. Blades 41 and 42 extend upwardly from opposite walls and blade 43 extends upwardly from the wall joining those from which 41 and 42 extend. Each blade extends upwardly and inwardly and then is bent outwardly again to form a U-shaped, resilient contact member. Blades 41 and 42 define a gap 44 between the innermost surfaces thereof to receive and frictionally engage a blade therebetween. Blade 43 cooperates with the side edges of blades 41 and 42 to define a gap 45 into which a blade can be inserted, gap 45 being perpendicular to gap 44.

The fourth side of the element is best seen in FIG. 6 and includes a relatively short upwardly extending member 47 and a somewhat longer member 48. Member 47 performs a structural function, that of assisting in the physical location of the element, but does not perform an electrical function. Portion 48, however, forms one contact of a switch which will be more fully described.

It will be observed that each of the members 40 is identical, contributing to the ease of manufacture of the structure. Each element is deposited in a rectangular cavity provided for that purpose, as described. Although each element will not necessarily be employed to receive plug blades in different orthogonal orientations, each element is capable of doing so.

Electrical power is supplied to the receptacle on wires 50 and 51 which pass through openings in the back wall of the receptacle provided for that purpose. The wires are insulated wires and the ends thereof are stripped and spot welded, or otherwise fixedly attached, to elongated electrically conductive plates 52 and 53, respectively, plate 53 and its associated wire being partly extracted from one side of the receptacle as illustrated in FIG. 3. It will be observed that plate 53 is generally T-shaped, having a depending portion which fits in slots 60 molded into an interior portion of the housing by which technique plate 53 is firmly located in its desired position parallel with one of the longer side walls of the housing. The welding or similar attachment of wire 51 to plate 53 is illustrated at 54. Plate 52 is similar shaped and mounted, although longitudinal displaced from plate 53, on the opposite side of the interior of the receptacle housing.

It will further be observed from FIGS. 3, 5, 7 and 8 that contact elements 56 and 57 are provided at the opposite ends of plate 53. Similar contact elements are provided on plate 52. These contact elements form the other half of the switch of which members 48 constitute a half, the relationship of these being best seen in FIGS. 6 and 7. As will be observed from FIGS. 6 and 7, contact 56 is normally spaced from the blade 48 closest thereto, forming normally open switches, and the same is true for each of the other blades and contact arrangements.

Figure 11:
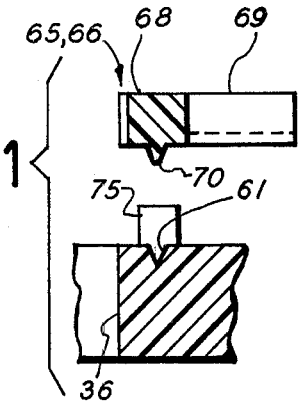
FIG. 11 is a partial exploded sectional view along line 11—11 of FIG. 8.

As seen in FIG. 3, the upper edge of each of ribs 36 and 37 is provided with a groove, the groove in rib 36 being identified as 61 and the groove in rib 37 being identified as groove 62. A generally L-shaped operating member 65 overlies rib 36 and its groove, and a similar member 66 overlies rib 37 and groove 62. Members 65 and 66 are identical, a total of four such members being used in the duplex receptacle illustrated. The operating members are shown in greater detail in FIGS. 9, 10 and 11, FIG. 11 being a sectional view along line 11—11 of FIG. 8 showing also the upper portion of a rib 36 and its groove 61. It will be observed that each L-shaped operating member has an elongated portion 68 and a perpendicular and a perpendicular leg 69 and, as seen in FIG. 11, portion 68 is provided with a downwardly extending V-shaped guide rib 70 along the entire bottom surface thereof. Guide rib 70 is shaped and dimensioned to be received in its associated groove, such as groove 61. The leg 69 has a flat bottom surface portion 72 and an L-shaped recess 73, the recess being provided so that leg 69 can pass partially over blade 43 of contact element 40 since blade 43 protrudes slightly upwardly above the upper limit of the recess in which element 40 fits. Surface 72 rests and rides on the upper surface of wall 35.

It will be observed from FIGS. 3 and 8 that the elongated portions 68 of the operating members are dimensioned to cover the associated rib and groove, one end of portions 68 being adjacent to upwardly extending blade 48 of the closest female element and the other end of that portion abutting an upwardly extending fixed stop member 75 which is integrally molded with the rib structure within the housing to limit the longitudinal movement of the operating member in a direction away from its associated female contact element.

It will also be seen, in FIGS. 9 and 10, that each leg 69 has an inclined cam surface 76 which is at an angle of about 55° with the upper surface of the operating member. It will further be observed from FIGS. 3 and 8 that surface 76 lies, in each case, at least partially over the gaps 44 and 45 in associated elements 40 so that a plug blade attempting to enter the gaps must engage the surface 76. Engagement of a blade, or other element inserted toward the contact element, must therefore act against cam surface 76, tending to move the operating member in a direction parallel with the longitudinal axis of member 68. Because of the guiding action of the rib and groove structures, such as rib 70 and groove 61 illustrated in FIG. 11, the movement is constrained to this longitudinal movement, causing the end of portion 68 farthest from its associated stop 75 to move against one of blades 48, causing that blade to bend and come in contact with one of contacts 56 or 57 on plate 52 or 53. This constitutes the switch closing action. It will be observed that the switch which is closed is on the opposite side of the receptacle from the female element toward which a blade or other body is being inserted. Thus, looking at FIG. 3, if a blade is inserted toward the element 40 closest to the grounding connector 25, 26, the operating member closest thereto will be moved to the left, closing the switch in the upper left hand corner of that figure. This energizes the left hand female element, but not the right hand one. In order to energize both of the upper elements in that figure, blades would need to be inserted in or toward both of the female elements.

The relationsip of the cam surfaces 76 and the openings 18 and 20 in cover 12 is also seen in FIG. 6. It will be observed that the cam surfaces lie directly below the openings so that, if one were to look into the openings, one would be able to see the cam surfaces.

Figure 5:
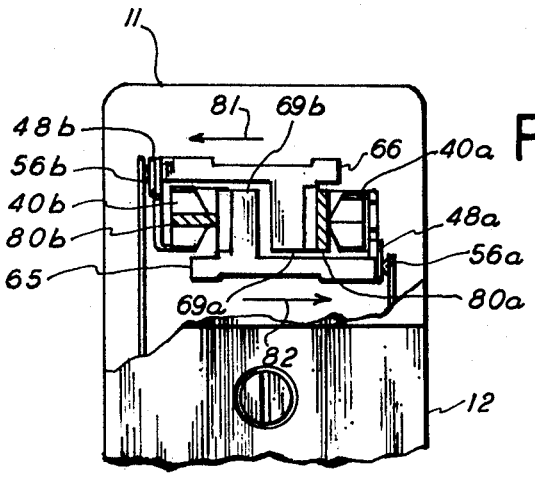
FIG. 5 is a simplified partial front elevation of the receptacle of FIGS. 1 and 3, and with the cover partly cut away, illustrating the operation of movable operating members for closing switches therein.

This action is illustrated in FIG. 5 which is given different reference numerals only for purposes of discussion. As seen therein, operating member 66 has a leg **68*a* adjacent a female element 40*a* which has a blade 48*a*** adjacent a contact element 56*a*. Operating member 65 has a leg 69*b* adjacent a female contact element 40*b* which carries a switch blade 48*b* adjacent a contact element 56*b*. Shown in section are two orthogonally disposed blades 80*a* and 80*b* of an orthogonal plug, these blades being in a position such that they have engaged and acted upon cam surfaces 76 of the operating members and moved those members but have not yet entered the associated female elements. Thus, blade 80*a* has caused member 66 to move in the direction of arrow 81, bending blade 48*b* to abut contact 56*b*, closing the switch and energizing element 40*b*. Simultaneously, blade 80*b* has engaged the cam surface of member 65, causing the member to move in the direction of arrow 82, bending blade 48*a* to abut contact 56*a*, energizing element 40*a*. Again, insertion of either blade alone would cause energization of only the element on the opposite side. Further, it will be observed that the switches are closed before electrical contact is made between the blades and their respective female elements.

Returning now to FIG. 2, it will be seen that the inner surface of the cover is provided with inwardly extending relatively short molded walls 84 and 85 which are opposite to, and parallel with, each other; and substantially aligned similar walls 86 and 87. These walls are spaced apart by a distance only slightly greater than the width of elongated portion 68 of each of the operating members and, when the cover is in position, they form additional guide surfaces for the operating members in their longitudinal movement, preventing any tilting action thereof. At the other end of the cover, similar walls 88, 89 and 90 perform the same function. Protrusions 91, 92, 93 and 94 extend inwardly to a greater depth and engage the upper ends of members 47 on elements 40 to keep the elements fully seated in their proper positions. C-shaped rectangular wall structures 95 and 96, which are formed of relatively shallow molded walls, engage short upstanding projections 97 at the upper ends of members 52 and 53 to also perform a mechanical supporting function. The remaining molded components on the interior of the cover perform additional guiding functions for the blades and for the other contact elements, but are not directly associated with the present invention.

While one advantageous embodiment has been chosen to illustrate the invention it will be understood by those skilled in the art that various changes and modifications can be made therein without departing from the scope of the invention as defined in the appended claims.

What is claimed is:

1. An improved electrical receptacle of the type having a housing, at least two electrically conductive female elements supported in said housing for receiving and making electrical contact with blades of a cooperating plug, a cover for said housing having openings therethrough aligned with said elements, first and second conductor means for electrically connecting each of said elements to a source of electrical power, first and second normally open switches, each of said switches being in series circuit relationship between one of said elements and one of said conductor means, first and second independently movable operating members each having a portion lying in a plane between said cover and said female elements, each of said members being elongated, electrically nonconductive and substantially rigid, each of said portion having a cam surface between one of said elements and its aligned cover opening so that a body inserted through one of said openings contacts a cam surface on one of said members and moves said member to close the one of said switches associated with the element aligned with the other opening before the body contacts the element behind said one opening, said housing including, first and second support ribs extending toward said cover, each of said support ribs having an upper surface spaced from the inner surface of said cover, the upper surfaces of said ribs being on opposite sides of said female elements, and wherein each of said members includes an elongated portion resting and longitudinally slidable on the upper surface of one of said ribs and a lateral portion extending toward the other one of said members.

2. A receptacle according to claim 1 wherein each of said members is electrically non-conductive and substantially rigid.

3. A receptacle according to claim 1 wherein each of said first and second conductor means comprises an elongated electrically conductive plate lying in a plane substantially perpendicular to said cover; and an insulated wire having a stripped end fixedly attached to said plate, said wire extending through an opening in said housing.

4. A receptacle according to claim 3 wherein each of said female elements includes a pair of generally U-shaped blades and a base portion interconnecting said blades so that said blades extend toward and away from each other to define a plug-blade receiving gap;

and wherein each said switch includes a switch blade electrically and mechanically attached to said U-shaped blades, said switch blade being resiliently bendable; and a contact member fixedly attached to an end of said electrically conductive plate, said switch blade and said plate being located such that resilient bending of said switch blade causes said blade to abut said contact member.

5. A receptacle according to claim 4 wherein said housing includes means for supporting said switch blade and said contact member beyond an end of one of said ribs so that longitudinal movement of one of said operating members in one direction causes resilient bending of said switch blade.

6. A receptacle according to claim 1 wherein at least one of said openings through said cover is T-shaped to receive a blade in either of two orthogonal orientations.

* * * * *